US007896687B1

(12) United States Patent
Schweitzer et al.

(10) Patent No.: US 7,896,687 B1
(45) Date of Patent: Mar. 1, 2011

(54) ELECTRICAL CONNECTOR WITH SLIDE MOUNTED ADAPTOR

(75) Inventors: Troy Wesley Schweitzer, Fort Wayne, IN (US); John Richard Taller, Huntertown, IN (US)

(73) Assignee: Excellon Technologies, Inc., Fort Wayne, IN (US)

( * ) Notice: Subject to any disclaimer, the term of this patent is extended or adjusted under 35 U.S.C. 154(b) by 0 days.

(21) Appl. No.: 12/799,463

(22) Filed: Apr. 26, 2010

(51) Int. Cl.
*H01R 13/58* (2006.01)
*H01R 13/62* (2006.01)

(52) U.S. Cl. ..... 439/457; 439/320

(58) Field of Classification Search ..... 439/457, 439/320, 271, 367, 455, 333
See application file for complete search history.

(56) References Cited

U.S. PATENT DOCUMENTS

| | | | | |
|---|---|---|---|---|
| 367,734 | A | | 8/1887 | Widdicombe |
| 2,374,971 | A | | 5/1945 | Benander |
| 3,675,184 | A | | 7/1972 | Vetter |
| 4,111,513 | A | | 9/1978 | Thurston et al. |
| 4,364,624 | A | | 12/1982 | Williams |
| 4,671,598 | A | * | 6/1987 | Keehne ..... 439/607.47 |
| 4,964,815 | A | * | 10/1990 | Kawai et al. ..... 439/607.25 |
| 5,244,417 | A | | 9/1993 | Perretta et al. |
| 5,342,203 | A | | 8/1994 | Perretta et al. |
| 5,831,815 | A | | 11/1998 | Miller et al. |
| 5,911,595 | A | | 6/1999 | Orr, Jr. et al. |
| 6,957,970 | B2 | * | 10/2005 | Weigel et al. ..... 439/320 |
| 6,966,797 | B2 | * | 11/2005 | Ko ..... 439/607.42 |
| 7,044,795 | B2 | | 5/2006 | Diep |
| 7,544,068 | B2 | | 6/2009 | Glaab, III et al. |
| 2001/0018293 | A1 | | 8/2001 | Van Zanten |

* cited by examiner

*Primary Examiner*—Chandrika Prasad
(74) *Attorney, Agent, or Firm*—George Pappas

(57) ABSTRACT

An electrical connector including a body, an insert, an adaptor and a cap. The body has a passage extending between first and second openings and an open-ended slot extending from the second opening. The adaptor has a hollow stem and a mounting section that slides into the slot to mount the adaptor to the body. An insert having electrical contacts extending therethrough is positioned within the passage. Wires extending through the hollow stem are conductively engaged with the contacts on the insert. A cap closes the second opening. A spacer can be positioned between the cap and insert to securely hold the insert between the stop surface and spacer. A method of assembling the electrical connector is also disclosed.

20 Claims, 3 Drawing Sheets

ELECTRICAL CONNECTOR WITH SLIDE MOUNTED ADAPTOR

BACKGROUND OF THE INVENTION

1. Field of the Invention

The present invention relates to electrical connectors and, more specifically, to an electrical connector that facilitates the assembly of the connector.

2. Description of the Related Art

Electrical connectors are used in a wide variety of applications. The use of standardized electrical connectors provides an easy and convenient method for establishing an electrical connection between two separate elements of an electrical circuit. The use of such electrical connectors is well known in the art. The manufacture of electrical connectors can, however, present difficulties.

For some applications, the size of one or both of the electrical connectors must be relatively small. This can present manufacturing difficulties. For example, many military vehicles have a communication system that utilizes a first electrical connector that is mounted within the vehicle. A communication device having a second electrical connector can be deployed with the vehicle by detachably connecting the second electrical connector with the first electrical connector. In such applications, physical size limitations are often imposed on the electrical connectors. The resulting electrical connectors are often referred to as "low profile" connectors.

The reduced size of such low profile connectors can present manufacturing difficulties. For example, low profile connectors typically include a connector body having a compact longitudinal length and an adaptor that extends laterally outwardly from the connector body. An insert having a plurality of either male or female contacts is mounted in the connector body for engagement with the other electrical connector. A wire bundle extends through adaptor and the individual wires of the bundle are each connected with one of the contacts on the insert. For such low profile connectors it is common to first attach the adaptor to the connector body, machine the adaptor after installation on the body and insert the wire bundle through the adaptor after machining the adaptor. Each of the wires are connected to one of the contacts on the insert after inserting the wire bundle through the adaptor and only then is the insert installed in the connector body. This sequence of events typically requires a wire-clearance cut-out on the insert to allow the insert to be installed in the connector body.

When manufacturing a connector in this manner, the post-installation machining of the adaptor significantly increases the expense of manufacturing the electrical connector and the wire-passage cut-out on the insert forms an undesirable manufacturing artifact on the final product. An electrical connector design that provided for the manufacture of a low profile electrical connector which eliminated one or both of these attributes of existing low profile connectors is desirable.

SUMMARY OF THE INVENTION

The present invention provides an electrical connector that can be readily assembled and facilitates the efficient manufacture of a low-profile connector.

The invention comprises, in one form thereof, an electrical connector that includes a body defining a passage extending from a first opening to a second opening. The body defines an open-ended slot that extends from the second opening. The connector also includes an adapter having a mounting section and a hollow elongate stem. The mounting section and the slot are slidably engageable such that the adapter is mountable on the body by sliding the mounting section into the slot with the stem extending outwardly from the body. An insert is disposed within the body and has a first surface, an opposite second surface, and a plurality of electrical contacts extending from the first surface to the second surface. The insert is positioned within the body with the first surface of the insert being operably accessible through the first opening of the passage. A plurality of wires extend through the hollow stem into the passage with each of the wires being conductively engaged with one of the electrical contacts. A cap is securable to the body wherein securement of the cap to the body closes the second opening.

The invention comprises, in another form thereof, an electrical connector that includes a body defining a passage extending from a first opening to a second opening. The body defines a radially inwardly projecting stop surface within the passage with the stop surface facing the second opening and an open-ended slot extending from the second opening. The connector also includes an adapter having a mounting section and a hollow elongate stem. The mounting section and the slot are slidably engageable wherein the adapter is mountable on the body by sliding the mounting section into the slot with the stem extending outwardly from the body. An insert is disposed within the body wherein the insert has a first surface, an opposite second surface, and a plurality of electrical contacts extending from the first surface to the second surface. The insert is positioned within the body with the first surface being operably accessible through the first opening of the passage. A plurality of wires extends through the hollow stem into the passage with each of the wires being conductively engaged with one of the electrical contacts. A cap is securable to the body proximate the second opening of the passage. A spacer is disposed within the passage between the cap and the insert wherein securement of the cap to the body secures the adapter within the slot, closes the second opening and biases the spacer toward the insert whereby the insert is securely positioned between the stop surface and the spacer.

The invention comprises, in yet another form thereof, a method of assembling an electrical connector. The method includes providing a connector body and forming a passage extending from a first opening to a second opening. An open-ended slot is also formed in the body wherein the slot extends axially from the second opening. The method also includes providing an insert having a first surface and an opposite second surface with a plurality of electrical contacts extending through the insert from the first surface to the second surface and an adapter with a mounting section and a hollow elongate stem. A plurality of wires are conductively engaged to the plurality of contacts and the insert is positioned within the passage of the body with the first surface facing the first opening after conductively engaging the plurality of wires to the plurality of contacts. The plurality of wires are extended through the hollow stem and the adaptor is installed on the body by sliding the mounting section into the slot at the second opening of the passage. A cap is installed on the body and closes the second opening.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein.

Figures 1, 2, 3, 4, 5:
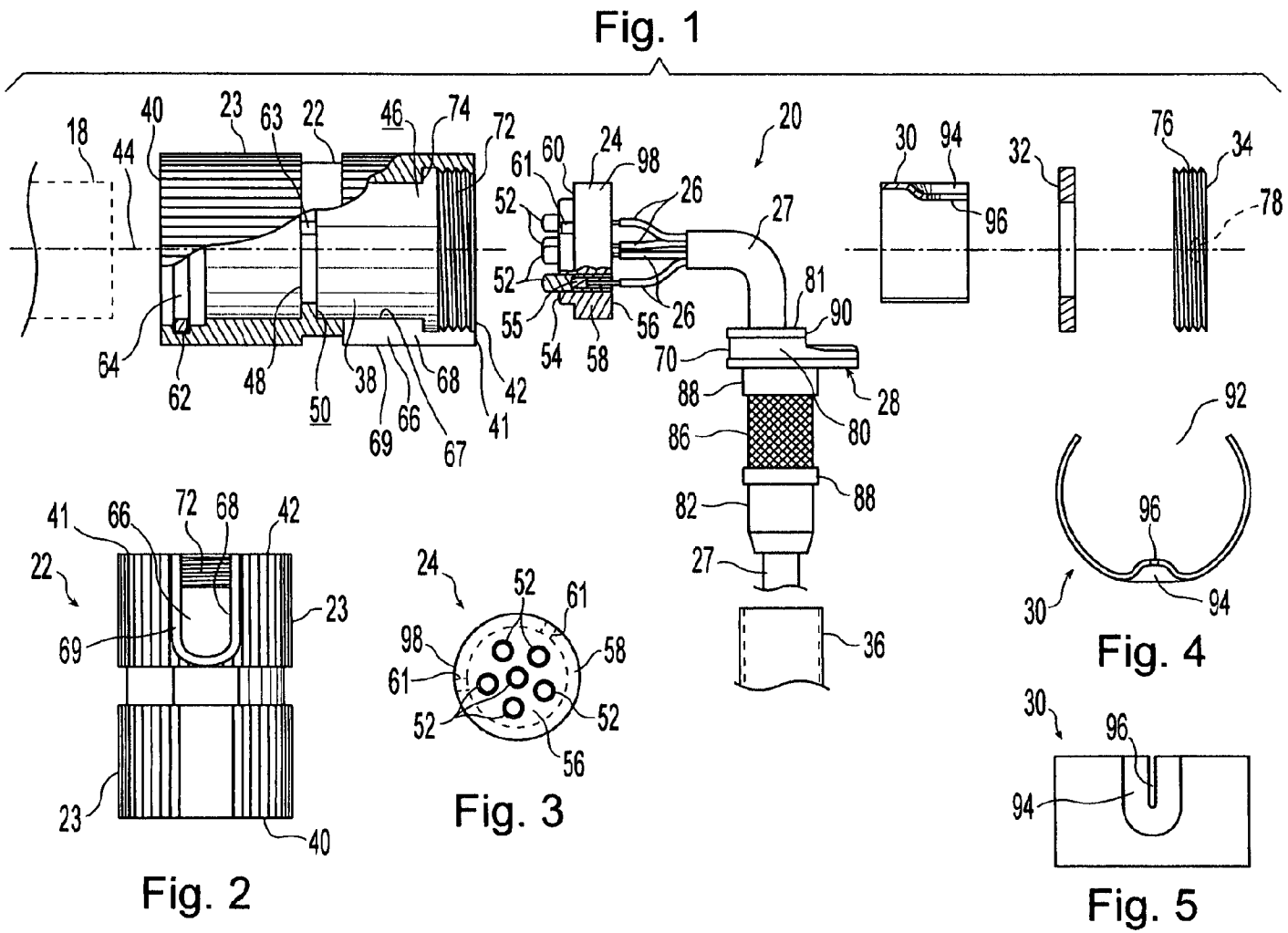
FIG. 1 is an exploded and partially cut-away side view of an electrical connector.
FIG. 2 is a bottom view of the connector body.
FIG. 3 is an end view of the insert.
FIG. 4 is an end view of the spacer.
FIG. 5 is a top (relative to FIG. 1) view of the spacer.
Figure 6:
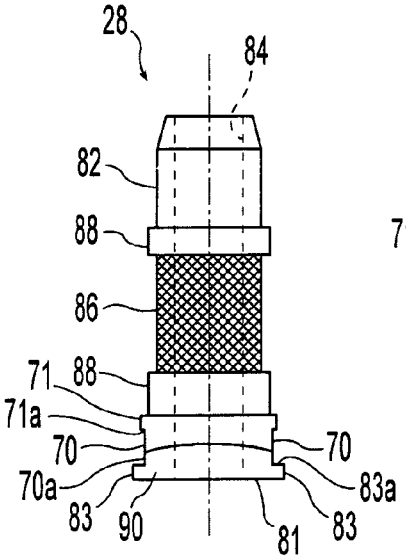
FIG. 6 is an end view of the adaptor.
Figure 7:
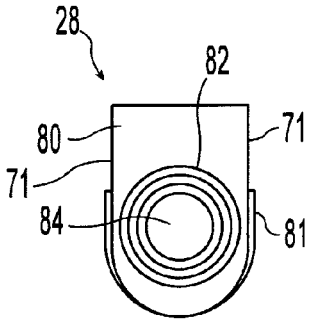
FIG. 7 is a bottom view of the adaptor.
Figure 8:
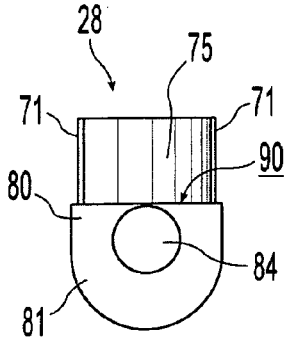
FIG. 8 is a top view of the adaptor.
Figure 10:
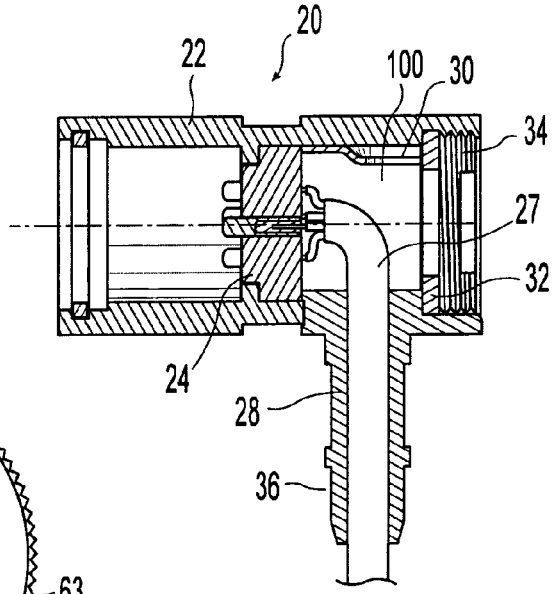
FIG. 10 is a cross sectional side view of an assembled connector.
Figure 9:
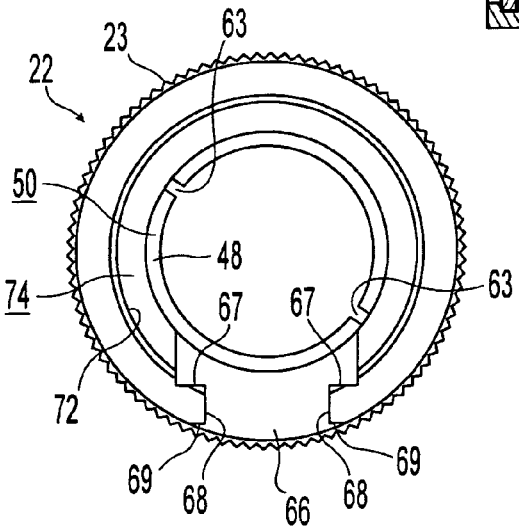
FIG. 9 is an end view of the connector body.
Figure 12:
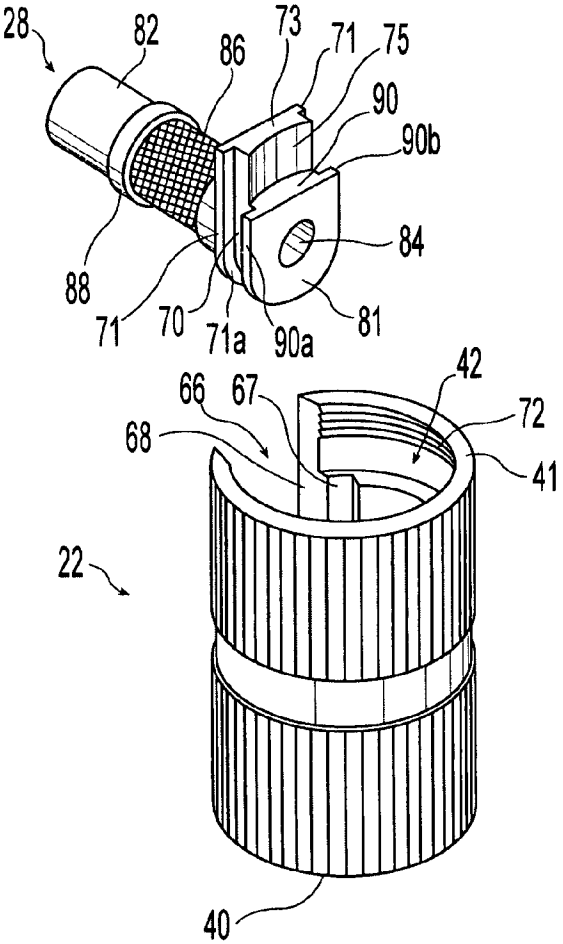
FIG. 12 is another exploded and schematic perspective view of the adaptor and connector body.
Figure 11:
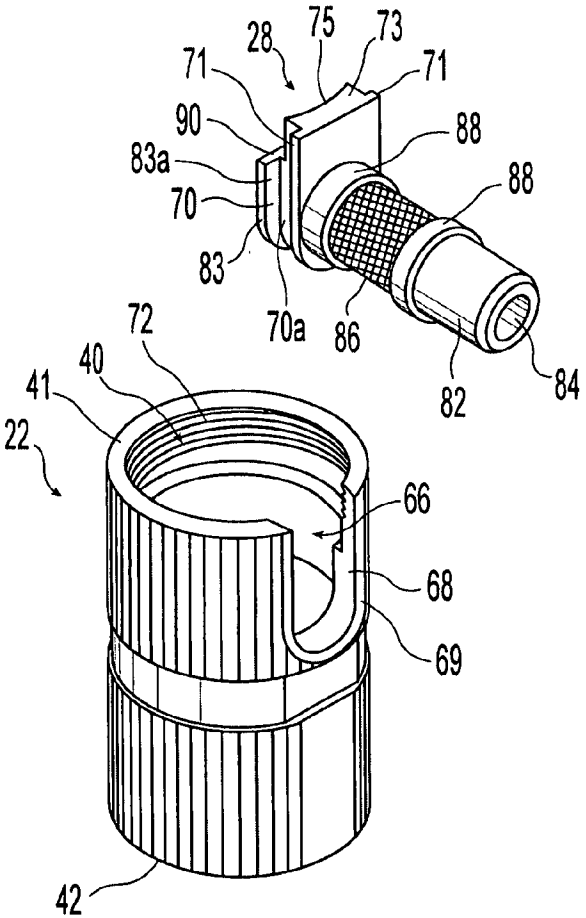
FIG. 11 is an exploded and schematic perspective view of the adaptor and connector body.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DETAILED DESCRIPTION OF THE INVENTION

An electrical connector 20 in accordance with the present invention is shown in an exploded view in FIG. 1. After describing the various parts of the illustrated connector 20, the assembly of connector 20 will be discussed. Connector 20 includes a connector body 22, an insert 24, a plurality of wires 26, an adaptor 28, a spacer 30, a resilient annular member 32 and a cap 34. An EMI (electromagnetic interference) sheathing 36 is attached to adaptor 28 to shield the braided wire cable 27 formed by wires 26 from electromagnetic interference. Sheathing 36 extends outwardly from adaptor 28 but does not form a part of the electrical connector 20.

Turning first to body 22, a passage 38 extends from a first opening 40 to a second opening 42 and defines an axis 44. The inner surface 46 of body 22 defines passage 38 and includes an annular flange 48 that projects radially inwardly into passage 38. Flange 48 defines a stop surface 50 that faces second opening 42. Insert 24 is installed in passage 38 by insertion through second opening 42 and stop surface 50 limits the axial movement of insert 24 toward first opening 40. Flange 48 also includes two assymetrically located notches 63.

Insert 24 is shown in FIGS. 1 and 3 and includes a plurality of electrical contacts 52 that extend from a first surface 54 to an opposite second surface 56 of the insert 24. The body 58 of insert 24 through which contacts 52 extend is formed out of an electrically insulative material. In the illustrated embodiment, insert body 58 is formed out of a polymeric material and takes the form of two cylindrical disks with the smaller diameter portion adjacent first surface 54 fitting within the opening of annular flange 48 and the larger diameter portion of insulative body 58 forming an annular surface 60 that engages stop surface 50. Insert 24 also includes two projecting tabs 61 that extend from surface 60. Tabs 61 are seated within notches 63 when installing insert 24. The assymetrical positioning of tabs 61/notches 63 requires that insert 24 be installed at a particular rotational orientation within passage 38.

At the first surface 54, contacts 52 form a standardized interface that allows insert 24 to be electrically coupled with a cooperating electrical connector 18. For example, the illustrated insert 24 forms a male insert with contacts 52 projecting outwardly from insulative body 58 and being engageable with a corresponding female component. In alternative embodiments of the present invention, insert 24 could be a female connector or have a custom, non-standardized configuration.

When insert 24 is installed within passage 38 with surface 60 engaged with stop surface 50, the standardized electrical connector interface formed by electrical contacts 52 at first surface 54 will be operably accessible through first opening 40 of passage 38. In other words, a cooperating electrical connector 18, schematically depicted in FIG. 1, can be inserted through opening 40 to conductively engage contacts 52. As can be seen in FIG. 1, a groove 62 can be formed in passage 38 proximate first opening 40 for holding an O-ring 64 to thereby sealingly engage the cooperating electrical connector 18 inserted into opening 40. Connector body 22 also includes exterior axially extending ridges 23 over a significant portion of its exterior surface that allow a user to more easily grasp connector body 22 when connecting or disconnecting the cooperating electrical connector 18.

At the second surface 56 of insert 24, contacts 52 form a cylindrical opening to thereby allow the conductive element of an individual wire 26 to be inserted into each of the contacts 52. Solder 55 is used to mechanically secure and form an electrically conductive engagement between the wires 26 and their respective contacts 52. Alternative methods of mechanically securing and conductively engaging wires 26 and contacts 52 can also be used.

Body 22 also includes an open-ended slot 66 that extends axially from second opening 42 and is defined by an edge 68. As can be seen in FIG. 2, slot 66 has a generally U-shaped configuration with the open-end of slot 66 terminating at second opening 42 to allow adaptor 28 to be installed in slot 66 by sliding adaptor 28 into slot 66 at opening 42. Adaptor 28 has a groove 70 that extends along a portion of its outer perimeter. Groove 70 firmly receives slot edge 68 when sliding adaptor 28 into slot 66 to thereby securely hold adaptor 28 within slot 66.

As can also be seen in FIG. 1, body 22 includes a helical thread 72 within passage 38 at second opening 42 and a radially inwardly projecting shoulder surface 74. Shoulder surface is positioned proximate second opening 42 and faces second opening 42. Thread 72 is located between shoulder 74 and second opening 42. Resilient annular member 32 is positioned on shoulder surface 74 and takes the form of a rubber washer in the illustrated embodiment. Cap 34 includes an exterior helical thread 76. Cap 34 is detachably secured to body 22 by engaging threads 72 and 76.

When cap 34 is secured to body 22, cap 34 compresses annular member 32 against shoulder surface 74. Annular member 32 is also compressed against spacer 30 and adaptor 28 when cap 34 is secured to body 22. Adaptor 28 and insert 24 are thereby secured in place by the installation of cap 34. Cap 34 includes a slot or other engagement feature 78 that allows cap 34 to be engaged manually or with a tool when securing cap 34 with body 22. In the illustrated embodiment, cap 34 includes a slot 78 that can be engaged with a flat-head screw driver.

Turning now to the adaptor 28, adaptor 28 includes a mounting portion 80 and a hollow elongate stem 82. When adaptor 28 is installed in slot 66, stem 82 extends outwardly from body 22 and a wire passage 84 extending through stem 82 is in communication with passage 38. In the illustrated embodiment, the exterior of stem 82 includes a knurled portion 86 located between two raised collars 88 to facilitate the termination and securement of EMI sheath 36 about the exterior of stem 82.

As mentioned above, adaptor 28 includes a groove 70 that extends along a portion of the outer perimeter of mounting section 80. Mounting section 80 includes a portion 81 that projects inwardly into passage 38. The inwardly projecting portion 81 defines a ledge surface 90 at its upper end. Inwardly projection portion 81 also defines a flange 83 along its perimeter. Surface 83*a* of flange 83 forms one sidewall of groove 70. Flange 83 and groove 70 extend along the outer perimeter of mounting section 80 from one end 90*a* of ledge surface 90 to the opposite end 90*b* of ledge surface 90. When adaptor 28 is installed in slot 66, ledge surface 90 is positioned substantially planar with shoulder surface 74 and forms a continuation of shoulder surface 74 across slot 66 such that ledge surface 90 and shoulder surface 74 extend along the entire circumference of passage 38. Annular member 32 engages either shoulder surface 74 or ledge surface 90 along the entire circumference of passage 38 when member 32 is compressed by the installation of cap 34. In the illustrated embodiment, that portion of mounting section 80 that is disposed between ledge 90 and second opening 42 is cutback and forms arcuate surface 75. Surface 75 does not project inwardly into passage 38 or interfere with the rotation of cap 34 as it is installed on body 22.

U-shaped groove 70 is formed by three surfaces, bottom surface 70*a* and sidewall surfaces 71*a* and 83*a*. As mentioned above, sidewall surface 83*a* is located on flange 83. Surface 71*a* is located on flange 71. Flange 71 extends along the perimeter of adaptor 28 opposite flange 83. Instead of terminating near surface 90, however, flange 71 extends to opposite ends of upper surface 73. Upper surface 73 of adaptor 28 is positioned substantially flush with surface 41 located at the axial end of connector body 22 when adaptor 28 is fully seated within slot 66.

When adaptor 28 is installed on connector body 22, bottom groove surface 70*a* engages edge surface 68, sidewall surface 71*a* engages surface 69 located adjacent slot 66 on the exterior surface of connector body 22, and sidewall surface 83*a* engages surface 67 located on adjacent slot 66 on inner surface of connector body 22. The engagement of the groove surfaces 70*a*, 71*a* and 83*a* with connector body 22 prevents relative movement between adaptor 28 and connector body 22 in all but the axial direction. Installation of cap 34 and the biasing of annular member 32 against surface 90 prevents axial movement of adaptor 28 in the assembled connector 20. It is also noted that the engagement of surface 70*a* with edge 68 and the engagement of surface 71*a* with surface 69 both extend for the full length of slot 66.

The assembled connector 20 also includes a spacer 30 that is disposed within passage 38 and positioned between insert 24 and cap 34. Spacer 30 is illustrated in FIGS. 1, 4 and 5 and has a generally C-shaped cross section. A gap 92 is defined between the two opposing limbs of the C-shaped configuration. Gap 92 extends axially and is aligned with stem passage 84 when spacer 30 is installed in passage 38 to allow for the passage of braided cable 27. An indentation 94 with an axially extending slot 96 is located opposite gap 92. Indentation 94 and slot 96 do not extend the full axial length of the polymeric spacer 30. The radially inwardly projecting indentation 94 ensures that spacer 30 will be engaged with annular member 32.

When cap 34 is attached to connector body 22, the cap 34 biases spacer 30 toward insert 24 and spacer 24 thereby biases insert 24 toward stop surface 50. As a result, insert 24 is securely held within the assembled connector 20 between stop surface 50 and spacer 30. When cap 34 is installed on body 22, the biasing of spacer 30 by cap 34 may be by either direct engagement of spacer 30 with cap 34 or through an intermediate part. For example, in the illustrated embodiment, spacer 30 engages annular member 32 instead of cap 34 with cap 34 biasing spacer 30 toward insert 24 indirectly through annular member 32. Similarly, intermediate parts can be located between spacer 30 and insert 24 and/or between insert 24 and stop surface 50. In the illustrated embodiment, insert 24 directly engages both stop surface 50 and spacer 30.

After assembling connector 20, including the installation of cap 34 on body 22, passage 38 forms an interior chamber 100 between insert 24 and cap 34 with stem passage 84 defining the sole opening into interior chamber 100. This interior chamber 100 is substantially sealed from the external environment due to the presence of annular member 32 and the engagement of annular surface 60 of insert 24 with annular surface 50 of flange 48 along the entire circumference of passage 38.

In many prior art low profile electrical connectors, it was necessary to form a cut-out in the insert to allow the insert to be positioned within the connector body after extending wires through an adaptor stem and connecting the wires to the insert. The present invention allows for the use of an insert without such a cut-out and thereby allows insert 24 to engage stop surface 50 along a greater portion of the circumference of passage 38. It also allows insert 24 to have a radial outer surface 98 that defines an outer perimeter of insert 24 that closely conforms to the dimensions of passage 38 adjacent stop surface 50. In other words, it allows outer surface 98 to be positioned substantially adjacent inner surface 46 of passage 38 along the entirety of the outer perimeter defined by outer surface 98 when insert 24 is installed within connector 20. This arrangement of insert 24 with the interior surface 46 of passage 38 and stop surface 50 limits the potential for moisture, dirt and other debris to enter chamber 100.

The method of assembling electrical connector 20 will now be discussed. When assembling electrical connector 20, braided cable 27 is inserted through stem passage 84 and the conductive elements of the individual wires 26 are exposed. Each of the conductive elements of wires 26, e.g., a copper wire, is then conductively engaged with a respective one of the contacts 52. In the illustrated embodiment, wires 26 are soldered to contacts 52. After connecting wires 26 and contacts 52, insert 24 is positioned in passage 38 proximate stop surface 50 with first surface 54 facing first opening 40. Either simultaneously or after positioning insert 24 in passage 38, adaptor 28 is installed by sliding adaptor 28 into slot 66 at opening 42 with slot edge 68 being received in groove 70.

It will generally be most convenient to remove any slack in wires 26 between insert 24 and adaptor 28 prior to installing insert 24 and adaptor 28 within and on connector body 22. This will typically mean that insert 24 will be positioned closely proximate adaptor 28 after connecting wires 26 to contacts 52 and removing any excess slack. As a result, when installing insert 24 and adaptor 28, the insert 24 will generally enter passage 38 through opening 42 with adaptor 28 following close behind. After insert 24 enters passage 38, adaptor 28 will be engaged with slot 66. Insert 24 and adaptor 28 will then be moved simultaneously in an axial direction toward opening 40. The axial insertion of insert 24 and adaptor 28 continues until insert 24 engages stop surface 50 and adaptor 28 is fully seated within slot 66.

It would also be possible to engage insert 24 with stop surface 50 and only then install adaptor 28 in slot 66. This installation sequence, however, would require additional slack in wires 26 between insert 24 and adaptor 28. If there were insufficient space within passage 38 for the slack wire, it would be necessary to remove the excess wire by pulling wires 26 through stem opening 84 after installing insert 24 and adaptor 28 within and on connector body 22. Thus, this alternative installation sequence will generally not provide the most desirable installation sequence.

After, or simultaneously with, the installation of insert 24 and adaptor 28, spacer 30 is positioned in passage 38 proximate insert 24. After installing spacer 30, annular member 32 is positioned on shoulder surface 74 and then cap 34 is installed. The installation of cap 34 closes second opening 42 and biases annular member 32 against spacer 30 and ledge 90 thereby securing insert 24 and adaptor 28 in place forming an inner chamber 100. The resulting electrical connector 20, while not fully water-proof, can be subjected to "waterspray" and still function properly.

A significant advantage provided by connector 20 is that adaptor 28 can be fully machined and wires 26 can be extended through stem passage 84 and connected with contacts 52 before installing insert 24 in passage 38 or mounting adaptor 28 on connector body 22. After connecting wires 26 with contacts 52 and extending the wires 26 through stem passage 84, the insert 24 and adaptor 28 can be easily installed within and on connector body 22. This configuration allows for a connector 20 having an inner chamber 100 between insert 24 and cap 34 with a relatively small axial length yet which can be manufactured and assembled with relative ease.

While this invention has been described as having an exemplary design, the present invention may be further modified within the spirit and scope of this disclosure. This application is therefore intended to cover any variations, uses, or adaptations of the invention using its general principles.

What is claimed is:

1. An electrical connector comprising:

a body defining a passage extending from a first opening to a second opening, said body defining an open-ended slot extending from said second opening;

an adapter having a mounting section and a hollow elongate stem, said mounting section and said slot being slidably engageable wherein said adapter is mountable on said body by sliding said mounting section into said slot with said stem extending outwardly from said body;

an insert disposed within said body, said insert having a first surface, an opposite second surface and a plurality of electrical contacts extending from said first surface to said second surface; said insert positioned within said body wherein said first surface is operably accessible through said first opening of said passage;

a plurality of wires extending through said hollow stem into said passage, each of said wires being conductively engaged with one of said electrical contacts; and a cap securable to said body wherein securement of said cap to said body closes said second opening.

2. The electrical connector of claim 1 further comprising a spacer disposed within said passage positioned between said insert and said cap and biasing said insert toward said first opening.

3. The electrical connector of claim 1 wherein said body defines a radially inwardly projecting shoulder surface within said passage proximate and facing said second opening and wherein said electrical connector further comprises a resiliently compressible annular member compressibly disposable between said shoulder surface and said cap when said cap is secured on said body.

4. The electrical connector of claim 3 wherein, when said adaptor is installed in said slot, a portion of said mounting section of said adaptor projects inwardly into said passage and defines a ledge surface positioned substantially planar with said shoulder surface and forms a continuation of said shoulder surface across said slot whereby said ledge is engageable with said resiliently compressible annular member.

5. The electrical connector of claim 4 wherein said body includes an edge defining said open-ended slot and said mounting section defines a groove extending along an outer perimeter of said mounting section from one end of said ledge surface to an opposite end of said ledge surface, said edge being slidably receivable within said groove.

6. The electrical connector of claim 1 wherein said body includes an edge defining said open-ended slot and said mounting section defines a groove extending along a portion of an outer perimeter of said mounting section, said edge being slidably receivable within said groove.

7. The electrical connector of claim 1 wherein said insert has a radially outer surface defining an outer perimeter and said radially outer surface is positioned substantially adjacent an inner surface of said passage along the entirety of said outer perimeter.

8. An electrical connector comprising:

a body defining a passage extending from a first opening to a second opening, said body defining a radially inwardly projecting stop surface within said passage, said stop surface facing said second opening, said body further defining an open-ended slot extending from said second opening;

an adapter having a mounting section and a hollow elongate stem, said mounting section and said slot being slidably engageable wherein said adapter is mountable on said body by sliding said mounting section into said slot with said stem extending outwardly from said body;

an insert disposed within said body, said insert having a first surface, an opposite second surface and a plurality of electrical contacts extending from said first surface to said second surface; said insert positioned within said body wherein said first surface is operably accessible through said first opening of said passage;

a plurality of wires extending through said hollow stem into said passage, each of said wires being conductively engaged with one of said electrical contacts;

a cap securable to said body proximate said second opening of said passage; and a spacer disposable within said passage between said cap and said insert wherein securement of said cap to said body secures said adapter within said lateral opening, closes said second opening and biases said spacer toward said insert whereby said insert is securely positioned between said stop surface and said spacer.

9. The electrical connector of claim 8 wherein said insert has a radially outer surface defining an outer perimeter and said radially outer surface is positioned substantially adjacent an inner surface of said passage along the entirety of said outer perimeter.

10. The electrical connector of claim 8 wherein said body defines a radially inwardly projecting shoulder surface proximate and facing said second opening and wherein said electrical connector further comprises a resiliently compressible annular member compressibly disposable between said shoulder surface and said cap when said cap is secured on said body.

11. The electrical connector of claim 10 wherein, when said adaptor is installed in said slot, a portion of said mounting section of said adaptor projects inwardly into said passage and defines a surface positioned substantially planar with said shoulder surface and forms a continuation of said shoulder surface across said slot whereby said ledge is engageable with said resiliently compressible annular member and said shoulder surface and said ledge surface extend along the entire circumference of said passage.

12. The electrical connector of claim 8 wherein said body includes an edge defining said slot and said mounting section defines a groove extending along a portion of an outer perimeter of said mounting section said edge being slidably receivable within said groove.

13. The electrical connector of claim 8 wherein said cap is threadingly engageable with said body at said second end.

14. Method of assembling an electrical connector, said method comprising:

providing a connector body and forming a passage extending from a first opening to a second opening;

forming an open-ended slot in the body wherein the slot extends from the second opening;

providing an insert, the insert having a first surface and an opposite second surface with a plurality of electrical contacts extending through said insert from the first surface to the second surface;

providing an adapter having a mounting section and a hollow elongate stem;

conductively engaging a plurality of wires to the plurality of contacts;

positioning the insert within the passage of the body with the first surface facing the first opening after conductively engaging the plurality of wires to the plurality of contacts;

extending the plurality of wires through the hollow stem;

installing the adaptor on the body by sliding the mounting section into the slot at the second opening of the passage; and installing a cap on the body to close the second opening.

15. The method of claim 14 further comprising the step of providing a spacer and positioning the spacer within the passage proximate the insert after positioning the insert within the passage and prior to installing the cap on the body and wherein the step of installing the cap on the body includes biasing the spacer toward the insert with the cap.

16. The method of claim 15 further comprising the steps of providing a resiliently compressible annular member and forming a radially projecting shoulder surface within the passage proximate and facing the second opening and wherein after the adaptor has been installed within the slot the spacer is positioned within the passage; then the annular member is positioned on the shoulder surface; and then the cap is installed on the body wherein installment of the cap compresses the annular member between the cap and the shoulder surface and biases the spacer toward the insert.

17. The method of claim 14 wherein the adaptor defines a groove along a portion of its outer perimeter and an edge of the slot is inserted into the groove when installing the adaptor on the body.

18. The method of claim 14 further comprising the step of providing a radially inwardly projecting stop surface with the passage and wherein the step of positioning the insert with the passage includes positioning the first surface of the insert proximate the stop surface to thereby limit axial movement of the insert toward the first opening.

19. The method of claim 18 further comprising the step of providing a spacer and positioning the spacer within the passage proximate the insert after positioning the insert within the passage and prior to installing the cap on the body and wherein the step of installing the cap on the body includes biasing the spacer toward the insert with the cap to therby bias the insert toward the stop surface.

20. The method of claim 14 wherein the insert enters the passage through the second opening prior to installing the adaptor on the body.

* * * * *